United States Patent [19]

Livne

[11] 4,448,353

[45] May 15, 1984

[54] POP-UP SPRINKLER

[75] Inventor: Zvi Livne, Shavei Zion, Israel

[73] Assignee: Dan Mamtirim, Israel

[21] Appl. No.: 415,971

[22] Filed: Sep. 8, 1982

[30] Foreign Application Priority Data

Sep. 14, 1981 [IL] Israel ..... 63830

[51] Int. Cl.[3] ..... B05B 15/10

[52] U.S. Cl. ..... 239/205; 239/206

[58] Field of Search ..... 239/203, 204, 205, 206, 239/600

[56] References Cited

U.S. PATENT DOCUMENTS 3,301,489 1/1967 Tropeano et al. ..... 239/204 X 3,791,581 2/1974 Chow ..... 239/204 X

*Primary Examiner*—John J. Love

*Assistant Examiner*—Mary F. McCarthy

*Attorney, Agent, or Firm*—Steinberg & Raskin

[57] ABSTRACT

A rotating "pop-up" sprinkler assembly having a rectangular buried container unit and a cam follower and cam track for automatically directionally aligning the sprinkler head as it returns to the container to thereby minimize the size of the container.

10 Claims, 8 Drawing Figures

POP-UP SPRINKLER

FIELD OF THE INVENTION

This invention is concerned with sprinkler systems and more particularly pop-up sprinkler assemblies used in a container buried in the ground and "pops up" to extend above the ground when the sprinkler system is turned on.

BACKGROUND OF THE INVENTION

Ideally a sprinkler system uses a minimum number of heads to provide controlled amounts of water to a maximum surface area. When not in use the sprinkler heads of "pop-up" sprinkler systems are below ground level. The presently available pop-up sprinkler systems are generally of the rotating variety whereby the sprinkler head automatically rotates as the water is sprayed therefrom to cover a maximum amount of area with a minimum number of sprinkers. When the water is not being sprayed, that is when the water is turned off then the sprinkler automatically returns to the container buried in the ground. Since the rotating sprinklers have heads that rotate the present day containers for the sprinklers in general are cylindrical units so that the head can be received in the container no matter what the position of the head when the water is turned off.

Cylindrical containers for the rotating sprinklers are comparatively large and thus take up an area that is otherwise useful for the cultivation of grass, flowers or vegetables. Furthermore, instead of providing an aesthetically picturesque lawn area the present day pop-up sprinklers actually cause ungainly looking lawn areas, pock marked with covered sprinkler containers. Furthermore, the larger the sprinkler container the more chance there is of somebody stepping thereon, breaking the cover and possibly being hurt when falling.

Another drawback of the present day pop-up sprinkler assemblies is the difficulty of disassembling the assemblies to remove the sprinkler heads from the container for repairs, adjustment or replacement. In this regard it is recognized that any miniaturization of the pop-up sprinkler assemblies in an attempt to diminish the area taken up by the containers would only add to the difficulties in disassembly.

Some prior art sprinklers representative of the art and showing some of the above noted deficiencies are as follows:

| U.S. Pat. No. | INVENTOR |
|---|---|
| 1605242 | J. H. Keys |
| 1665371 | J. H. Keys |
| 2989247 | J. C. Tropeano et al. |
| 3063645 | J. C. Tropeano et al. |
| 3086714 | J. C. Tropeano et al. |
| 3301489 | J. C. Tropeano et al. |

Accordingly it is an object of the present invention to provide new and improved pop-up sprinkler systems in which the above-referred to disadvantages are substantially reduced or overcome.

SUMMARY OF THE INVENTION

According to the present invention a pop-up sprinkler assembly is provided, said assembly comprising:

a rotating sprinkler head having a longitudinal dimension that is longer than the width of said head, a rectangular housing unit set into the ground for receiving said rotating sprinkler head therein, the width of said unit being shorter than the length of said head, means for causing said head to rise above said housing unit when said sprinkler system is turned on, means for returning said head to said unit when said system is turned off, and means for aligning the length of said head with the length of said unit as said head returns to said unit whereby said head is returned to said housing unit regardless of the orientation of said head when it is turned off.

A feature of the system is the ease in which each of the pop-up sprinkler assemblies can be disassembled and reassembled.

A further feature of the inventive pop-up sprinkler assembly is the interrelated surfaces that orient the head in its return to the housing unit. The interrelated surfaces include a first surface attached directly to said sprinkler head which relates to a second surface which is part of the sprinkler assembly rather than part of the housing unit.

BRIEF DESCRIPTION OF THE DRAWINGS

The operation and utilization of the present invention will be more fully apparent from the description of a preferred embodiment taken in conjunction with the following drawings, in which.

GENERAL DESCRIPTION

Figure 1:
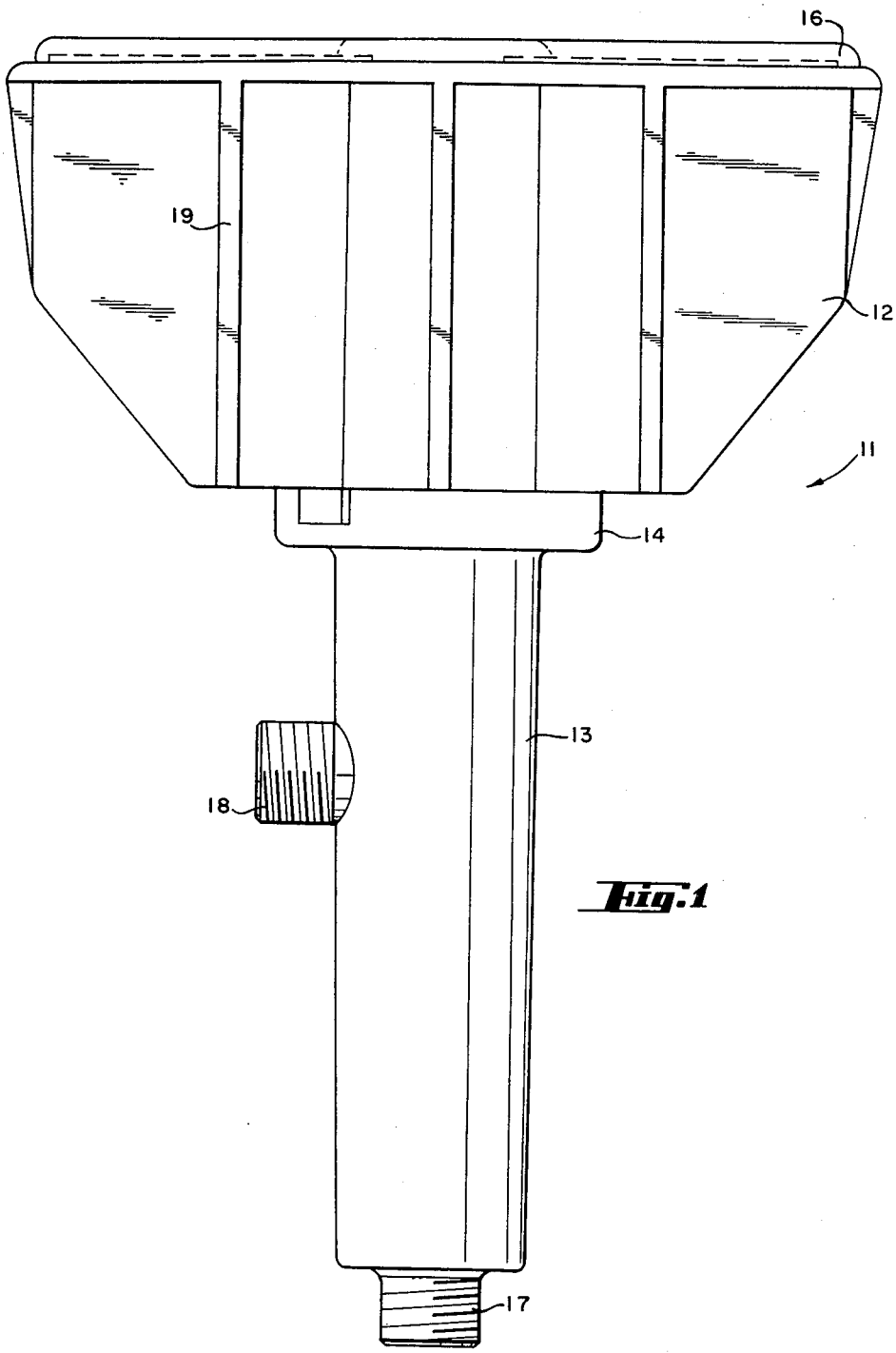
FIG. 1 is a side view of a pop-up sprinkler unit.
Figure 2:
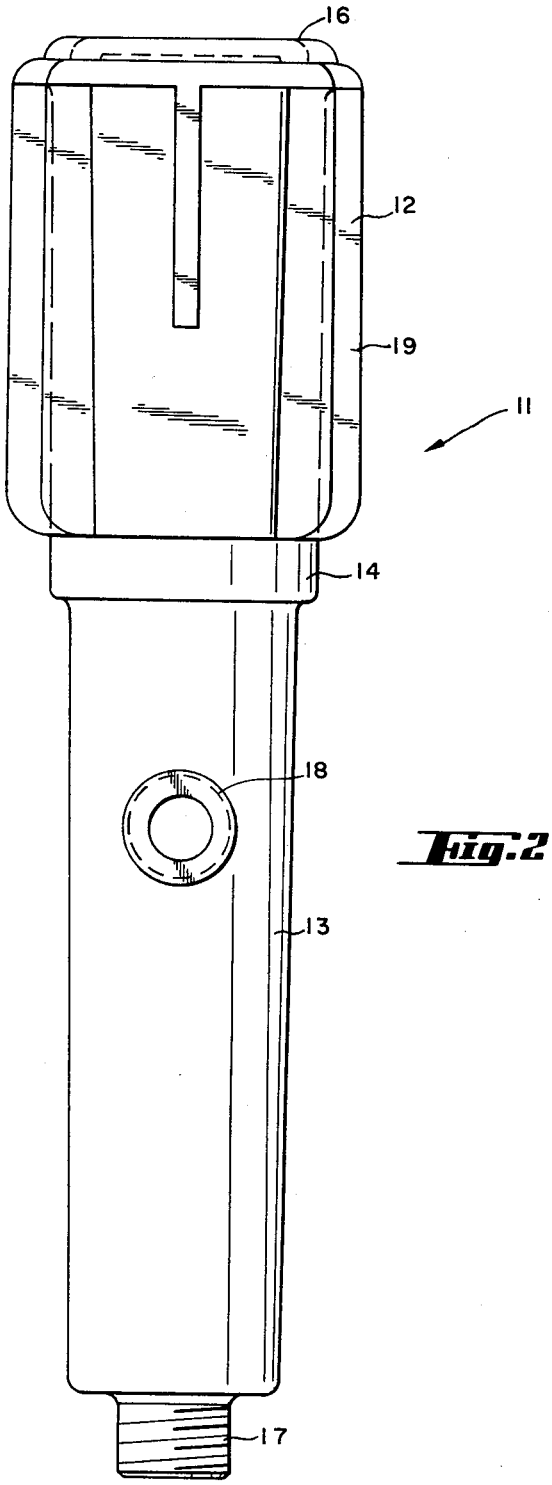
FIG. 2 is a front view of the pop-up sprinkler unit.

The pop-up sprinkler assembly 11, is shown in FIGS. 1 and 2 as comprising an outer housing unit that includes a main substantially rectangular body section 12 and extending therefrom a stem section 13. Between the stem section 13 and the main body section 12 is an intermediate coupling section 14. The top of the main body section is capped with cap 16 and the stem section 13 is shown as including a bottom water connecting or entry portion 17 and a side water entry portion 18. The stem section and the body section may be separate parts or the whole body assembly may be integrally molded together. The main body section is shown in FIG. 1 as having reinforcing ribs such as for example, rib 19, for strengthening of the main body section. It should be understood that if water inlet 17 is operative then water inlet 18 is plugged and vice versa.

Figure 4:
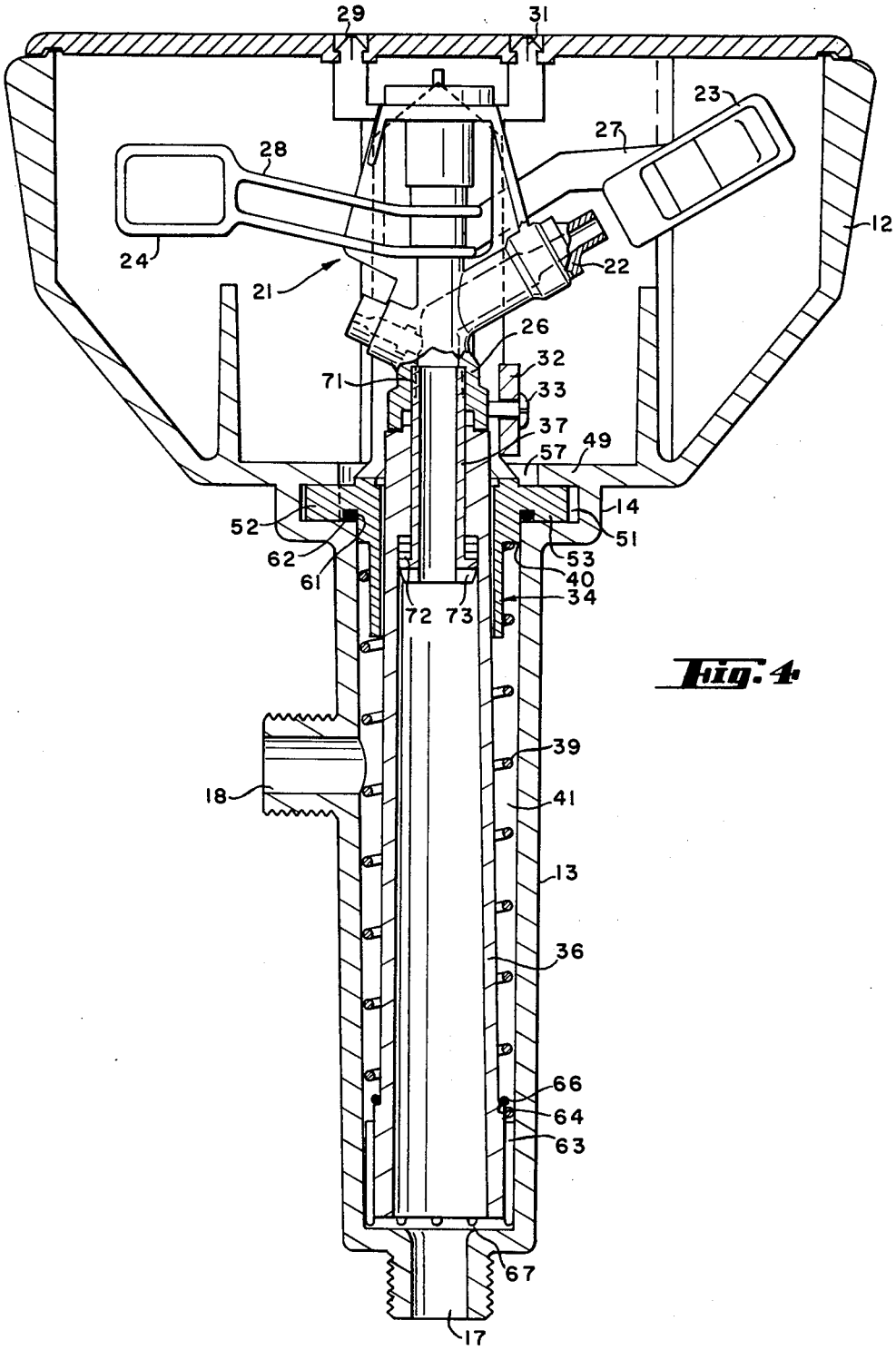
FIG. 4 is a sectional side view of the pop-up sprinkler unit of FIG. 1.

The cross-sectional view of FIG. 4 shows the assembly with the water turned off and the sprinkler head completely within the casing or housing unit. The sprinkler head shown generally at 21 can be any well known type of rotating sprinkler such that the jet of water itself imparts rotating motion. In general, sprinkler heads such as rotating sprinkler head 21 comprises a water sprinkling outlet 22 and a sprinkler rotation actuation vane 23 which serves the dual purpose of spreading the water and receiving the impinging jet.

Separated and approximately 180° from the vane 23 is the counter-weight 24. Both the vane and the counter-weight extend from the stem 26 of the sprinkler head on arms 27 and 28 respectively.

Figure 5:
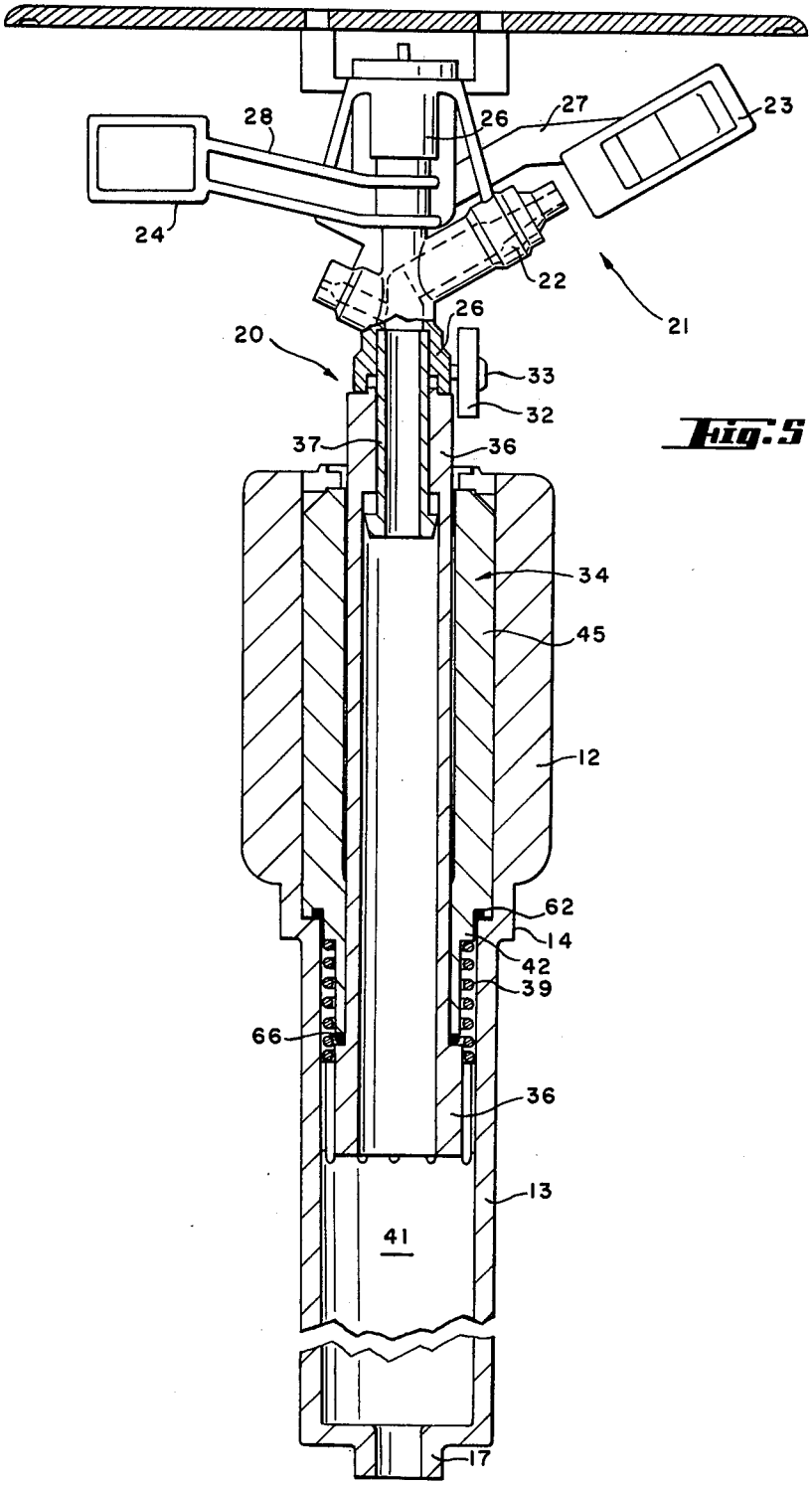
FIG. 5 is a sectional front view of the pop-up sprinkler assembly in its extended sprinkling position.

Attached to the head unit 21 is the cap 16. Here it is shown attached by means such as press fit pins 29 and 31 for example. Any well known means can be used to retain the cap to the sprinkler. In fact hinge means can be used to retain the cap onto the main body 12 of the housing unit. However in the preferred embodiment the cap is attached directly to the head as shown in FIGS. 4 and 5. This eliminates the spring and hinge arrangement otherwise necessary to assure that when the sprinkler returns to the housing the housing is properly covered.

Means are provided for orienting the sprinkler head to assure its longitudinal alignment with a longitudinal axis of the housing unit when the water is turned off. This means comprises a pair of interrelated surfaces. For example a cam surface is provided which also is part of a coupling member coupling the "pop-up" head to the housing unit. A cam follower is shown attached to the head. The cam surface apparatus for aligning the head is removably attached to the housing and acts in fact to lock the sprinkler head to the housing unit. Thus the complete cam-surface apparatus is referred to herein as a cam surface and sprinkler head locking unit 34. The sprinkler head locking unit shown herein serves the dual function of orienting the sprinkler head for its proper return to the housing and for locking the sprinkler head to the housing. When the unit 34 is unlocked from the housing the whole assembly 20 including sprinkler head 21, the locking unit 34, a piston 36 and the piston and head fluid coupling cylinder 37 are all removable as a unit from the housing. The piston 36 is a hollow cylinder communicatively coupled to the water source. The coupling cylinder 37 couples the piston to the head mechanically and hydraulically.

This capability of easy disassembly adds to the versatility of the pop-up sprinkler assembly in that the complete unit is replaceable or can easily be serviced outside the housing unit. Thus component parts of the complete assembly including unit 21, 34, 36 are readily and easily changeable, removable and replaceable.

Figure 6:
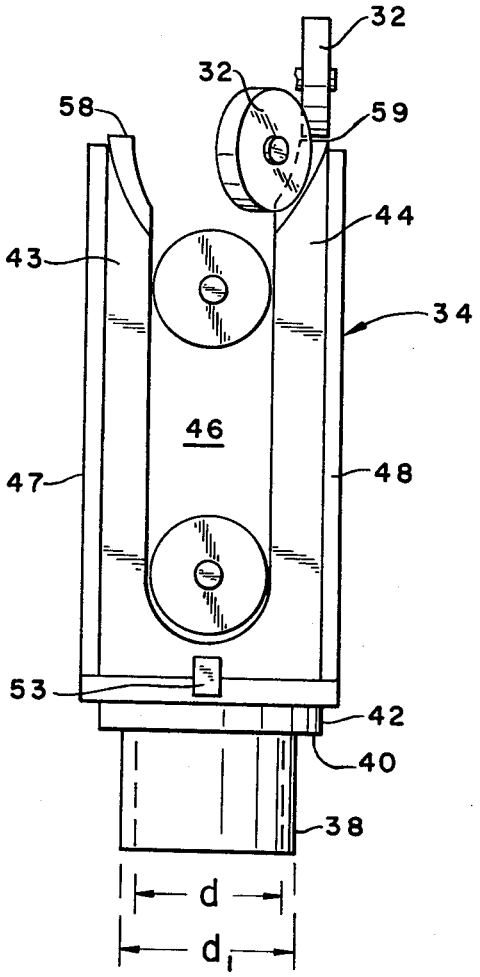
FIG. 6 is a showing of cooperating surfaces that control the orientation of the rotating head to assure proper alignment with the housing unit.

The cam surface and sprinkler head locking unit 34 is basically a multicylinder unit with a common inner diameter d that is geometrically large enough to movably receive piston member 36 therein. A spring 39 receiving outer diameter $d_1$ extends upwardly at the bottom of the unit 34 over cylinder sub-unit 38. Spring 39 is reliably retained in the piston receiving chamber 41 of the stem 13. In other words, the pop-up sprinkler is normally retained in its unextended or retracted position because of the spring forces of spring 39. Spring 39 normally rests against ledge 40 at the bottom of the mid-cylinder 42. The top cylinder 45 is bifurcated, terminating in two upwardly extending prongs 43 and 44 separated by channels 46. The channels 46 are sized to receive the cam follower member wheel 32. Ribs 47 and 48 extend outwardly from each of the prongs 43 and 44. As the stop action portrayal of FIG. 6 shows the cam follower wheel 32 moves from the bottom of the channel 46 upwardly when the sprinkler head is forced upward responsive to water pressure after the water is turned on. The wheel 32 is guided from surfaces 58 or 59 to the bottom of the gap 46 when the water is turned off. The gap 46 is positioned to align with the longitudinal axis of the housing unit. The wheel is attached to the head unit coaxially with the longitudinal dimension of the head unit. Thus the wheel following the cam surface guides the head unit to align with the housing unit regardless of when the water is turned off.

Figure 3:
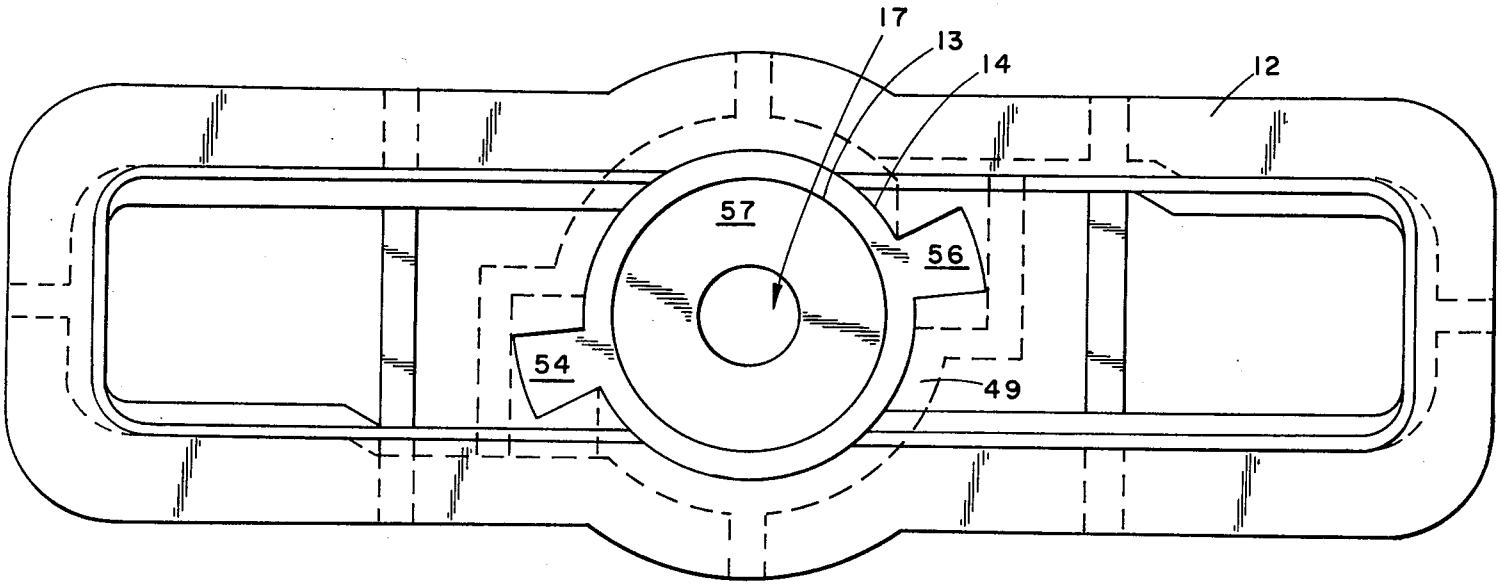
FIG. 3 is a plan view of the pop-up sprinkler housing unit.

Means are provided for locking unit 34 into the housing 12. More particularly coupling portion 14 of the housing includes a larger diameter section overlapped by a smaller diameter lip 49. The overlap portion is shown as hollow portion 51. A pair of oppositely disposed projections 52 and 53 extend horizontally outward from unit 34. The prongs are designed to fit into space 51 under lip 49. Oppositely extending grooves or slots 54 and 56 (FIG. 3) in the lip 49 receive the horizontally extending locking projections 52 and 53, respectively, of unit 34 and lock the unit 34 onto the main body of the pop-up rotating sprinkler housing.

In the horizontally extending projections 52 and 53 of unit 34 there is a peripheral slot 61 for receiving sealing means such as O-ring 62. In a like manner the piston 36 includes at the bottom thereof a peripheral bearing surface 63 as well as ledge 64 for receiving sealing means such as O-ring 66. The bearing surface 63 also serves as a stopper for spring 39. At the bottom of the piston there are ribs such as rib 67 used to provide passageway for fluid when the fluid receiving entranceway 18 is used.

The coupling means 37 is threaded at the top 71 thereof and is attached to the rotating head unit 21 by meshing threads on stem 26 thereon. The bottom portion of the unit 37 has an enlarged diameter portion 72 so that the coupling unit in cross-section is substantially T-shaped to lock the piston in fluid communication with sprinkler head 21. The bottom of the coupling unit has a slot therein shown as slot 73 for receiving means, such as a screwdriver for unfastening the coupling unit from the rotating sprinkler head unit and consequently the piston from the rotating sprinkler head unit. This can be done after the rotating sprayer assembly including the piston and the cam locking unit are removed from the housing.

FIG. 4 shows the rotating sprayer in the retracted position while FIG. 5 shows the rotating sprayer in the extended position. In the extended position the spring 39 is compressed, the O-ring 66 is pressed against the bottom of unit 34 thereby preventing the leakage of any water between the piston and unit 34. Pressure on the O-ring 62 similarly prevents the escape of any fluid between the casing and the unit 34. In the extended position the sprayer rotates and sprays a large area. As soon as the water is turned off the sprayer returns to its retracted position and is aligned by the cam follower following the cam surface to cause the extended portions such as the arms with the counterweight 24 and the vane 23 to align with the longitudinal axis of the housing unit 12.

The entire unit of course is placed into the ground, connected to a fluid source through inlets 17 or 18. When the water is turned on then the head unit with the cover and piston attached extends upwardly. The piston compresses the spring 39. When the water is turned off the unit realigns itself and fits into the narrow housing portion.

A unique feature of the device is the ease with which the whole thing can be disassembled while the unit is in the ground. If there is something wrong with the unit then the rotating sprayer is pulled up and the piston 36 is turned while the bottom of the piston 36 forces the O-ring 66 against the locking unit 34 turning the locking unit until the projections 52 and 53 align themselves with the slots or grooves 54 and 56 in the lip 49 to free the locking unit and enable lifting the whole rotating sprayer assembly 20 from the housing unit. It can then be replaced and the rotating sprayer assembly can be repaired without interfering with the sprinkler system.

Figure 8:
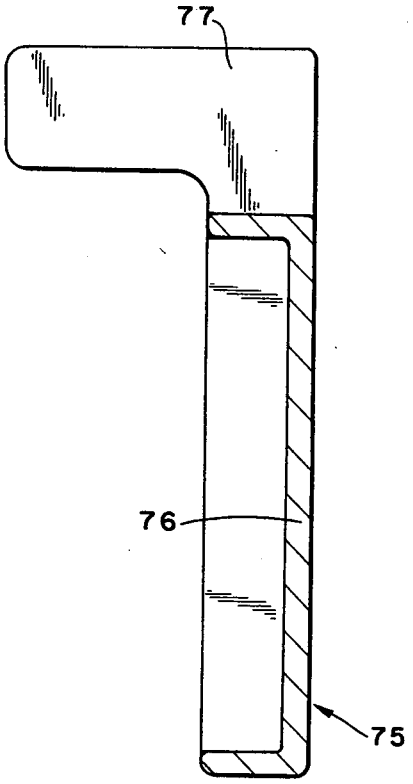
FIG. 8 is a sectional view of the wrench of FIG. 7.

Means are provided to make it even easier to disassemble the pop-up rotating sprinkler. More particularly a unique wrench 75 is shown in FIGS. 7 and 8 for accomplishing the disassembly and assembly of the rotating sprayer to enable removing the rotating sprayer assembly 20 from the housing unit or for returning the rotating sprayer assembly to the housing unit.

Figure 7:
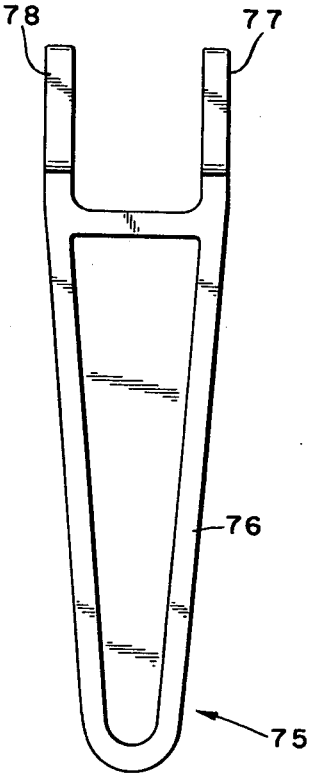
FIG. 7 is a plan view of a special wrench used to facilitate assembly and disassembly of the pop-up unit.

The wrench as shown in FIG. 7 comprises a substantially U-shaped handle portion 76 which extends to a pair of spaced apart parallel downwardly extending sections 77 and 78 respectively. The parallel sections 77 and 78 are placed around the unit 34 substantially parallel to the ribs 47 and 48. Turning the handle 76 in a clockwise or counter-clockwise direction turns the unit 34 so as to remove the horizontally extending projections from under the lip into the slots, thus enabling easy removal of the whole assembly. The assembly is returned to the housing in the same manner using the wrench 75.

Thus the pop-up rotating sprinkler assembly fits into a housing unit that does not detract from the aesthetics of the field in which it is placed, performs efficiently and effectively. The assembly is easily disassembled and assembled thereby making the repair of the sprinklers in the sprinkler system relatively easy.

While the principles of the invention have been described above in connection with specific apparatus and applications, it is to be understood that this description is made by way of example only and not as a limitation on the scope of the invention.

What I claim is:

1. A pop-up sprinkler assembly for pop-up sprinkler systems, said sprinkler assembly comprising:

a rotating sprinkler head having a longitudinal dimension that is larger than the width of said head, a housing unit having substantially rectangular cross-sections, said housing unit set into the ground for receiving said sprinkler head therein, the width of said unit being shorter than the length of said head, means for causing said head to rise above said housing unit when said sprinkler system is turned on to apply water pressure to said sprinkler assembly, means for causing said head to return to said housing unit when said system is turned off, and means for aligning the length of said head with the length of said unit as said head returns to said unit, said aligning means comprising cam follower means and cam follower track means for said cam follower means, said cam follower means comprising wheel means, said wheel means mounted to said head through axle means, and said axle means being in parallel to the longitudinal axis of said head.

2. The assembly of claim 1 wherein said sprinkler head is part of a sprinkler unit, said sprinkler unit including piston means, said piston means having a retracted and an extended position relative to said housing, means for attaching the rotating sprinkler head of said assembly to said piston means, and locking means included in the assembly for locking said assembly to said housing, whereby when said last named means is unlocked said assembly is unlocked from said housing.

3. The assembly of claim 2 wherein said locking means includes a portion of said aligning means.

4. The assembly of claim 2 wherein said locking means includes cam surfaces for aligning said sprinkler head.

5. The assembly of claim 4 wherein said locking means comprises a bifurcated unit having two upwardly oppositely disposed spaced apart prongs with a pair of wheel receiving slots therebetween forming said cam follower track means, said cam surfaces being located on said prongs, and said wheel receiving slots located on a line perpendicular to the longitudinal axis of said rectangular housing unit.

6. The assembly of claim 2 wherein said housing unit comprises a top section that is substantially rectangular, a stem section extending downwardly from said top section, a coupling section between said stem section and said top section, and said coupling section including means for cooperating with said locking means to selectively retain said sprinkler unit in said housing unit.

7. The assembly of claim 6 wherein said coupling section comprises a cylindrical compartment defined by top lips, lip slots in said lips wherein said locking means comprises a pair of spaced apart projections dimensioned to fit through said lip slots to be confined by said lips during rotation when passing through said slots to thereby lock said locking means.

8. The assembly of claim 6 wherein coupling means are provided for mechanically coupling said locking means to said rotating sprinkler head.

9. The assembly of claim 8 wherein said stem section comprises water inlet means, said coupling section comprises piston means movable in said stem section for hydraulically coupling said rotating sprinkler head to said water inlet means, and said piston means having an extended and a retracted position.

10. The assembly of claim 8 wherein said locking means includes wrench gripping surface means.

* * * * *